United States Patent [19]

Böddeker et al.

[11] 3,979,078

[45] Sept. 7, 1976

[54] BEATER BAR FOR ROTORS OF IMPACT MILLS

[75] Inventors: Hans-Joachim Böddeker, Munster; Rolf König, Handorf, both of Germany

[73] Assignee: Hazemag Dr. E. Andreas KG, Munster, Germany

[22] Filed: Mar. 14, 1975

[21] Appl. No.: 558,719

[30] Foreign Application Priority Data

Mar. 15, 1974 Germany ..... 2412507
Mar. 15, 1974 Germany ..... 2412508

[52] U.S. Cl. ..... 241/191; 241/197; 241/285 B

[51] Int. Cl.[2] ..... B02C 13/28

[58] Field of Search ..... 241/191–193, 241/195, 197, 285 B, 294

[56] References Cited

UNITED STATES PATENTS

| | | | |
|---|---|---|---|
| 2,747,803 | 5/1956 | Hanse | 241/191 |
| 2,889,119 | 6/1959 | Andreas | 241/294 X |
| 3,098,614 | 7/1963 | Meyer | 241/294 X |
| 3,531,055 | 9/1970 | Alt | 241/192 |
| 3,756,519 | 9/1973 | Reynolds | 241/191 X |
| 3,784,117 | 1/1974 | Koenig et al. | 241/195 X |

FOREIGN PATENTS OR APPLICATIONS

| | | | |
|---|---|---|---|
| 956,188 | 1/1957 | Germany | 241/191 |

*Primary Examiner*—Granville Y. Custer, Jr.
*Assistant Examiner*—Howard N. Goldberg
*Attorney, Agent, or Firm*—Michael J. Striker

[57] ABSTRACT

An elongated bar body has two opposite side faces each provided with a longitudinally extending rib. The ribs are offset from the longitudinal midline of the respective side faces in opposite directions and due to this offsetting each of the side faces has a larger and a smaller face portion. The larger face portions of the side faces overlap one another partially in transverse direction.

17 Claims, 10 Drawing Figures

Fig. 6
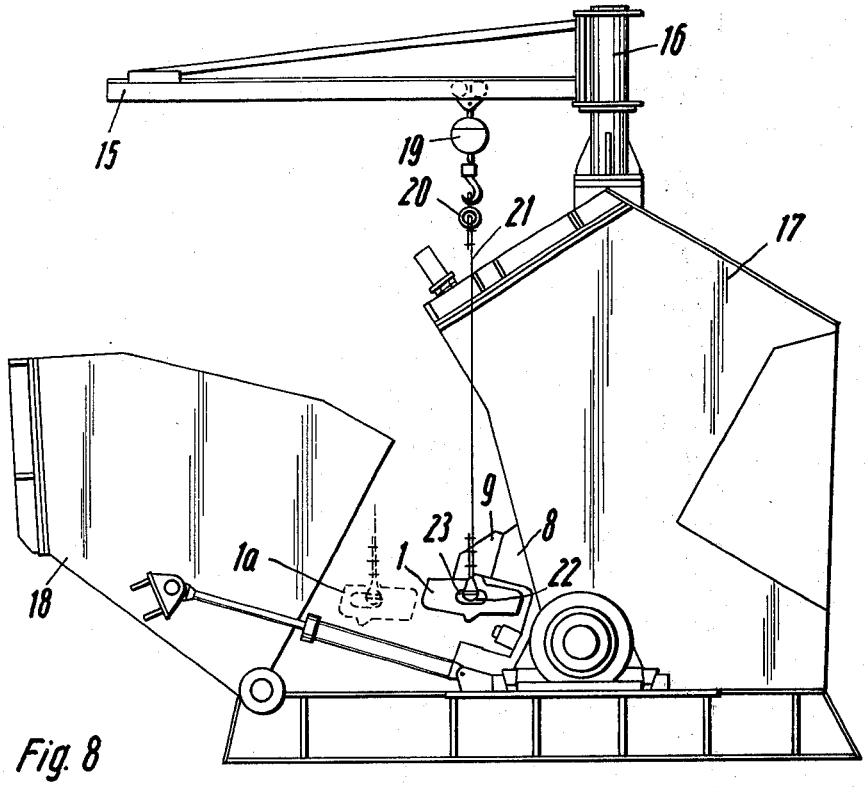
Fig. 8
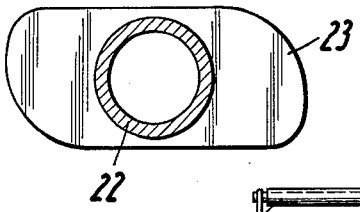
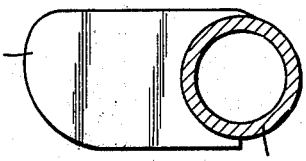
Fig. 9
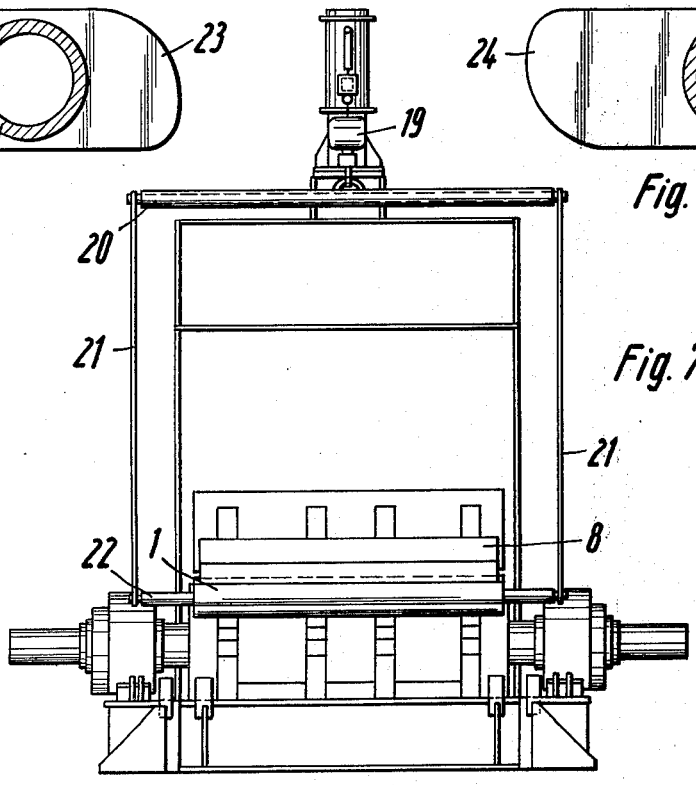
Fig. 7

BEATER BAR FOR ROTORS OF IMPACT MILLS

BACKGROUND OF THE INVENTION

The present invention relates to a beater bar for rotors of impact mills.

Beater bars of this type are known in the art in a variety of constructions. They have a symmetrical or radial-symmetrical cross-sectional configuration, so that after they have been worn along one longitudinal edge in the rotor they can be turned either about their transverse axis or about their longitudinal axis through 180°, and be reinstalled so that the other longitudinal edge can now be used until it is worn. Beater bars of this type are disclosed, for example, in U.S. Pat. No. 2,747,803 and in German Pat. Nos. 1,143,380 and 1,607,619.

Usually, these beater bars are inserted into axially parallel slots formed on the rotor periphery and are secured in these slots, for example by being wedged in place with the aid of one or more wedges. For this purpose they are provided with side faces which engage corresponding surfaces on the rotor, and opposite side faces which engage the wedges, the latter in turn engaging corresponding surfaces of the rotor.

The known beater bars of this type have a relatively complicated cross-sectional configuration and are formed in their side faces with longitudinally extending grooves or cut-outs. This has been found to be a major cause of fractures in the beater bars. A further disadvantage is that these known beater bars usually also have relatively narrow faces with which they contact the rotor and the wedges, respectively, so that shifting of the beater bars under the influence of blows acting upon them can readily occur.

SUMMARY OF THE INVENTION

Accordingly, it is an object of the present invention to overcome the disadvantages of the prior art.

More particularly, it is an object of the invention to provide an improved beater bar for rotors of impact mills which is not possessed of these disadvantages.

In keeping with these objects, and with others which will become apparent hereafter, one feature of the invention resides in a beater bar for rotors of impact mills which, briefly stated, comprises an elongated bar body having two opposite side faces each provided with a longitudinally extending rib, the ribs each being offset from the longitudinal mid-line of the respective side faces in opposite directions. Due to the offsetting of the ribs each of the side faces has a larger and a smaller face portion, and the larger face portions of the side faces overlap one another partially.

The cross-sectional configuration of the beater bar is rectangular, parallelogram-shaped or double-trapezoidal, and the beater bar of the present invention is very strong and stable.

The narrower or smaller face portions act advantageously as beating faces and the wider or larger face portions cooperate, particularly with their overlapping parts, with the associated surfaces of the rotor and the wedges, respectively. The wedges in turn are supported on an appropriate surface of the rotor in known manner. Since the four planar face portions of each bar body all extend to the outer edges of the bar body, a very simple configuration of the beater bar is obtained. This is advantageous in many ways, including in the production of such beater bars which are usually made by casting.

If the beater bar is of double-trapezoidal cross section, then it is in some instances also possible to eliminate special longitudinally extending ribs, since the face portions of each side face include with one another an obtuse angle and thus in effect constitute a form of longitudinal rib which can be utilized for securing the beater bar in the rotor against loosening by centrifugal forces. Of course, separate ribs can nevertheless be provided, and in this case they are advantageously located in the region of the lines of intersection between the larger and smaller face portions of the respective side faces, in order to obtain a simple cross-sectional configuration for the beater bar.

It should be pointed out that beater bars with double symmetrical longitudinal cross section, provided at each side with a longitudinally extending rib, are already known from U.S. Pat. No. 3,098,614. However, unlike the present invention the longitudinal ribs are located opposite one another and are centrally arranged, and the beater bars are loosely inserted into rotor slots and not held by wedges.

According to a further concept of the invention the contact surfaces for the wedges can be made wider by providing the longitudinal ribs at one or several locations with cut-outs whose base surfaces constitute an extension of the larger face portions, that is which are located in the same plane as the larger face portions. This increases the overlap of the larger face portions which is important for the firm mounting of the beater bar in the rotor. In addition, these cut-outs can be used to fix the beater bar against axial displacement in the rotor, simply by providing projections on the rotor which engage into the cut-outs. However, it is also possible to use the wedges for this purpose since they extend into the cut-outs in any case. The wedges must then be guided on the rotor itself against axial displacement. The cut-outs will then of course advantageously have a length which corresponds to the width of the wedges.

It is most advantageous if the cross-sectional configuration of the ribs is triangular, and if those surfaces of the ribs which face towards the larger face portion are steeper than the surfaces of the ribs which face towards the smaller face portions, because it is the steeper surfaces via which centrifugal forces are transmitted.

To increase their lifetime and make them more resistant to wearing, the outer edges or margins of the respective smaller face portions may be provided with a reinforcing bead. This does not detrimentally influence the simplicity of the cross-sectional configuration of the beater bar, and the simplicity of manufacturing it, e.g. by casting.

The turning of the beater bars to compensate for one-sided wear, their removal and their re-installation is not a simple matter, particularly in the case of large-dimensioned rotors. Particularly when the beater bars are worn, they do not offer any surfaces for engagement by lifting devices such as cranes or the like. The present invention eliminates these difficulties.

The beater bar according to the present invention has a compact cross-sectional configuration, in contradistinction to those of the prior art which are laterally inwardly recessed at the center of their cross section. It may be provided with a hollow which extends over the entire length of the beater bar in the region of the central longitudinal axis of the same. It is a simple matter to insert a mounting rod through this hollow and to have its opposite ends extend beyond the opposite ends of the beater bar, so that these outwardly projecting ends can be engaged and thereby utilized to move the beater bar during removal and reinstallation, as well as during turning. In the case of smaller rotors this can be done manually, and in the case of larger rotors it can be done by means of a crane or the like. As soon as the beater bar has been disengaged from the rotor it can be moved to its new position, for example turned through its transverse or longitudinal axis, and immediately be reinstalled. The movement to the new position is effected simply by turning the beater bar through 180° about its longitudinal axis if the cross section of the beater bar is radially symmetrical. If the cross section is mirror symmetrical, then the same rotation is carried out and in addition the beater bar is rotated about a vertical axis, i.e. end-for-end. The hollow can advantageously also be used for the purpose of pulling the beater bar axially out of the rotor by inserting a tension element into the hollow and securing one end of the tension element by means of a cross bar or the like at the axial end of the beater bar which faces opposite to the direction in which the beater bar is to be withdrawn from the rotor.

The hollow can be provided particularly simply in the beater bars having a double-trapezoidal cross section which tapers towards the ends. In addition to the advantages outlined above the provision of the hollow affords a substantial saving in material for the manufacture of the beater bar, and also offers advantages in the production of the beater bar by casting. By eliminating the solid cross-section of the beater bar, due to the formation of the hollow, the problems which have been experienced in the casting of such beater bars relating to the formation of voids, and non-uniform cooling of the beater bar resulting in the formation of fractures, are largely avoided.

Preferably, the hollow will have a cross section which is elongated in the direction of elongation of the cross section of the beater bar itself. Such a configuration makes it possible in a simple manner to provide the mounting rod with guide plates which are mounted on the rod and which correspond in outline to the cross-sectional configuration of the hollow and inserted into the hollow. Thus, they will hold the mounting rod within the centroidal axis of the beater bar, a feature which is of particular advantage if the beater bar is to be removed and installed on that side of the rotor which in operation moves downwardly, and in horizontal orientation, because under such circumstances the beater bars are difficult to keep properly oriented unless they are mounted as outlined.

It is particularly advantageous if two separate mounting rods are provided, one of which is provided with guide plates for new and unworn beater bars and the other of which is provided with guide plates for beater bars which are worn at one side. In the case of the first mounting rod the guide plates are so constructed that they will hold the mounting rod in the longitudinal central axis of the beater bar and therefore at the center of the hollow. In the case of the second mounting rod the associated guide plates will be so constructed that they will hold the mounting rod in a position in which it is located closer towards one end of the cross section of the hollow, thereby locating it in the centroidal axis of the one-sidedly worn beater bar. The first-mentioned rod with the associated plates is, incidentally, also possible in case of beater bars which are worn on both sides.

In lieu of providing two separate mounting rods and two separate sets of guide plates it is also possible to use a single mounting rod and a set of guide plates which are each provided with a central hole and an eccentric hole, so that they can be pushed onto the mounting rod using either the central or the eccentric hole. It is advantageous in this case if the guide plates are provided with arrangements by means of which they can be secured at the desired axial location of the mounting rod, so that they do not shift relative to the mounting rod when they are inserted with the same into the hollow.

The length of the mounting rod or rods is advantageously so selected that their opposite end portions will not only extend past the ends of the beater bar to a certain extent, but will also extend outwardly past the side walls of the housing in which the rotor is mounted for rotation. This makes for a particularly simple handling of the beater bar since the end portions of the mounting rod are then readily accessible. If a lifting device is provided to engage these end portions, it will advantageously have a yoke whose length approximately equals the length of the mounting rod and whose ends can then be connected with the end portions of the mounting rod by means of ropes, chains or the like. If these ropes or chains are sufficiently long, then the beater bars can be very readily handled, particularly in the type of impact mills wherein the housing can be opened by folding back a portion of the housing, since the yoke will always be located above the housing and need not be inserted into the same.

It is advantageous if the longitudinal axis of the cross section of the hollow extends at a relatively small acute angle with reference to the longitudinal axis of the cross section of the beater bar itself. In this case the distance of the opposite ends of the hollow at diametrally opposite sides will be greater from the side faces of the bar body than at the other sides. This means that at both ends of the cross section of the hollow at one side the bar body will have a greater wall thickness than at the other side. It is then to be installed in the rotor in such a manner that the side with the greater wall thickness is located outwardly and forwardly with respect to the direction of rotation of the rotor so that in operation it will be subjected to tensile forces, whereas the opposite weaker side is subjected to pressure forces.

Particularly advantageous wall thickness relationships can be obtained if in the case of double-trapezoidal beater bar bodies the distance of the hollow to the smaller side face portions is greater than to the larger side face portions.

The casting molds for casting beater bars according to the present invention can be made particularly simply if the parting line of the mold sections is so located that it is in a longitudinal plane which coincides with a diagonal line passing through the cross section of the beater bar. According to a further concept of the invention the cross section of the beater bar is therefore so selected that it, including the longitudinal ribs and the reinforcing bead, will have no undercuts with respect to this diagonal line. If the beater bar is provided with the earlier-mentioned hollow, then this also should not be provided with undercuts relative to this diagonal line.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 6 is a somewhat diagrammatic side view of an impact mill in which the housing is opened and where a beater bar is being manipulated;

FIG. 7 is a rear view of the impact mill in FIG. 6, with parts of the housing removed for clarity;

FIG. 8 is a cross section through a mounting rod with a centrifugally mounted guide plate thereon;

FIG. 9 is a cross section through a mounting rod with a eccentrically mounted guide plate thereon.

DESCRIPTION OF THE PREFERRED EMBODIMENTS

Figure 1:
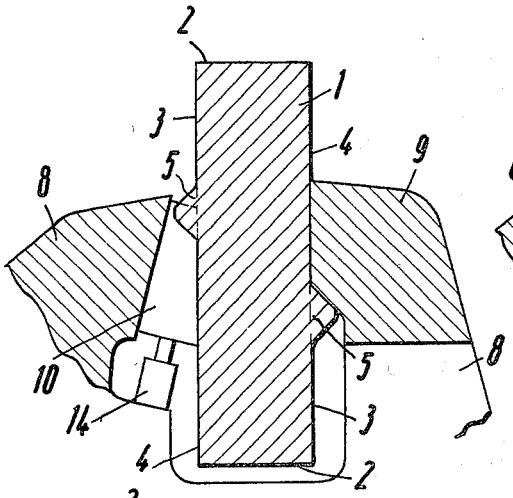
FIGS. 1–4 are diagrammatic transverse cross sections illustrating different embodiments of the beater bar of the present invention, shown in each case with associated portions of the rotor.

Referring to FIG. 1 it will be seen that the beater bar 1 therein is of rectangular cross section. The opposite narrow edge faces are identified with reference numeral 2, whereas each of the side faces connecting the two edge faces 2 is subdivided by respective longitudinally extending ribs 5 into a narrower or smaller face portion 3 and a wider or larger face portion 4. The ribs 5 are offset relative to one another out of the midpoint of the cross section, and therefore the larger and smaller face portions 4 and 3 come into being. Due to this offsetting the larger face portions 4 at the opposite sides overlap one another to a substantial extent as shown.

Figure 2:
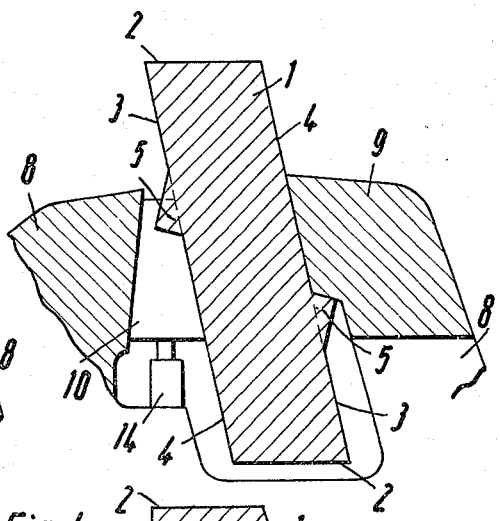

The embodiment in FIG. 2 is reminiscent of that in FIG. 1, and differs from it essentially only in that the beater bar of FIG. 2 has a parallelogram-shaped cross section. The smaller face portion 3 which —as in the other embodiments—constitutes the beating which will hit the material to be comminuted in an impact mill in which the beater bar is to be used, is inclined slightly forwardly as shown. The embodiment in FIG. 3 differs from FIGS. 1 and 2 in that its cross section resembles a double trapezoid which converges or tapers towards the ends.

Figure 3:
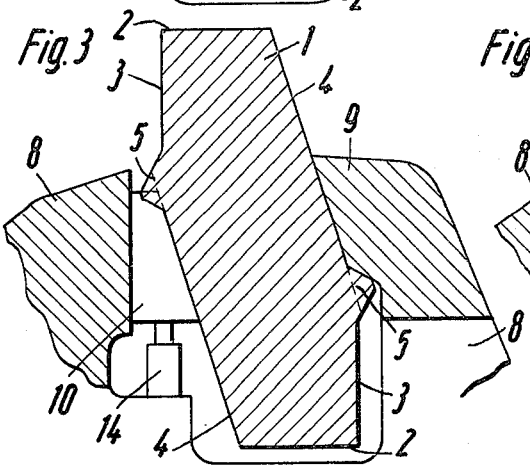
Figure 4:
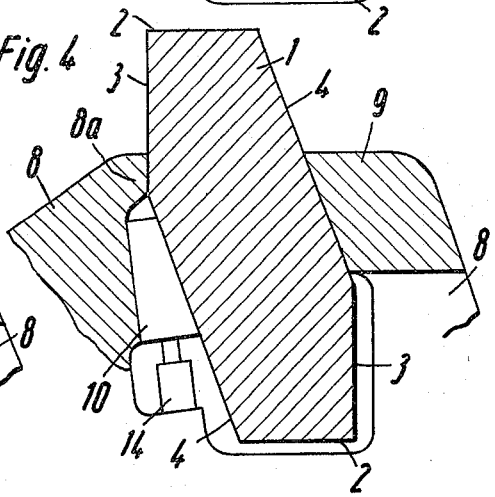

In the embodiment in FIG. 4 the beater bar has a cross-sectional configuration resembling the one in FIG. 3, but in FIG. 4 the separate ribs 5 have been omitted. The beater bar of FIG. 4 is secured in the rotor by a nose 8*a* provided on the rotor and which engages one of the face portions 3 as shown. Reference numeral 10 identifies a wedge which—as with the before mentioned embodiments—presses the face portion 4 located at the opposite side of the beater bar firmly against a supporting part 9 of the rotor.

Figure 5:
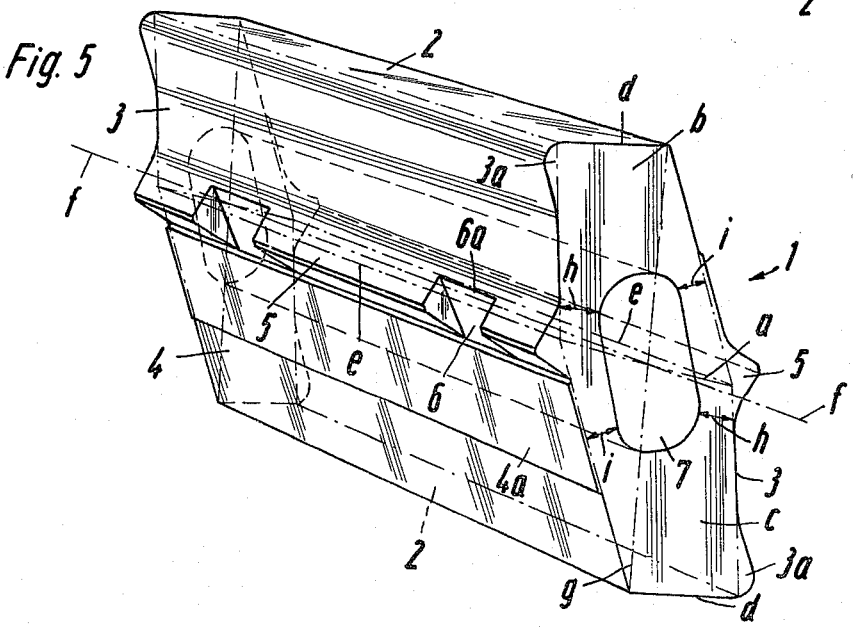
FIG. 5 is a perspective view illustrating the beater bar of FIG. 3.

FIG. 5 shows the embodiment of FIG. 3 in a perspective view. This embodiment is currently preferred and will be seen to have a cross-sectional configuration composed of two trapeziums *b* and *c* whose longer base lines *a* contact one another. The shorter base lines *d* are located at the edge faces 2. The lines of intersection of the larger and smaller face portions at each side which are inclined to one another at an obtuse angle, are identified with reference character *e*. To eliminate sharp edges which tend to break away during the operation of the impact mill, the beater bar 1 is provided at the outer margins or edges of the face portion 3 with bead-shaped reinforcements 3*a*. The face portions 4 are slightly raised and machined at the strip-shaped parts 4*a* which are located adjacent to the lines of intersection *e*.

The longitudinal ribs 5 are of triangular profile (but could have a different cross-sectional configuration) and are provided with cut-outs 6 whose base surfaces 6*a* are located in the plane of the portions 4*a*. Only the front ones of these cut-outs 6 are shown; the cut-outs in the rear rib 5 have not been illustrated to avoid confusion.

The beater bar in FIG. 5 has a longitudinal central axis *f*. In the region of this axis there is provided a hollow 7 which extends over the entire length of the bar and is so arranged that its spacing *h* from the smaller face portions 3, where the beater bar is stressed in tension, is greater than the spacing *i* from the opposite larger face portions 4 where the beater bar is stressed in compression. A diagonal line across the cross section of the beater bar is identified with reference character *g*, and advantageously the parting plane of a casting form in which the beater bar is to be cast, will extend in the plane of this line. With respect to this line *g*, the entire beater bar, including the hollow 7, is free of any undercuts.

If a beater bar of the type shown in FIGS. 1–5 is installed in a rotor 8 of an impact mill (this is diagrammatically shown in FIGS. 1–4) which turns in counterclockwise direction, so that the face portion 3 facing in the direction of rotation constitutes the beating face, then the portion 4*a* of the side face which is directed oppositely to the direction of rotation of the rotor will engage the supporting member 9 of the rotor, and the rib 5 at that side will engage the supporting portion 9 from below. On the forward side (the side facing the direction of rotation) two wedges 10 are pressed by hydraulic rams 14 against the portion 4*a* of the forwardly facing face portion 4 and the machined base surfaces 6*a* of the cut-outs 6 into which the wedges 10 extend. The arrangement is such that the small face portion 3 which constitutes the beating face extends approximately radial to the axis of rotation of the rotor.

Coming to FIGS. 6 and 7 it will be seen that a mounting arm 15 may be provided on the stationary housing portion 17 of an impact mill, on which it may be mounted for turning about an upright axis by means of a vertical pivot 16. To facilitate repair and maintenance of the interior components of the impact mill, the mill has a housing portion 18 which can be swivelled to open position as shown in FIG. 6. When the housing is thus opened, a load lifting device 19 on the arm 15 and carrying a yoke 20, can be used to remove a beater bar, and to reinstall it or replace it with another one. For this purpose a mounting rod 22 is secured with its opposite axial ends to the ropes, cables, chains or the like 21 (only one shown) after first having been inserted through the hollow 7 of the beater bar so that its opposite axial ends project beyond the ends of the beater bar. The beater bar is held by the arm 15 and pulled from below upwardly against the portion 9 of the rotor, while the wedges 10 are either inserted or removed. The mounting rod 22 is provided in the region of its opposite ends with two (or more) guide plates 23 or 24 (compare FIGS. 8 and 9) whose cross-sectional configuration corresponds to the cross section of the hollow 7, so that when these plates are received in the hollow 7, they will maintain the rod 22 in the centroidal axis of the beater bar. The plates 23 or 24 may be removable from the mounting rod 22, or else they may be secured in place, e.g. by welding.

In FIG. 8 the plates 23 have the mounting rod 22 extending centrally through them, so that this arrangement is suited for manipulating of beater bars which are not yet used, for example which are new, since the plates 23 will hold the mounting rod in the longitudinal central axis of the hollow. The embodiment of FIG. 9 has the mounting rod 22 extending eccentrically through the guide plates 24. This arrangement is for use with beater bars which are worn on one side, so that it compensates for this wear (compare the phantom-line showing of the beater bar 1*a* which is shown disengaged in FIG. 6) to make it readily turnable prior to re-installation.

Figure 10:
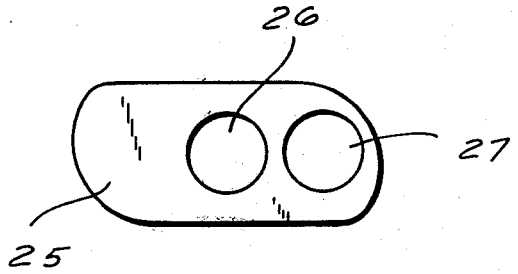
FIG. 10 is an elevational view of another type of guide plate.

As pointed out before, the guide plates 23 or 24 need not be provided on separate mounting rods 22. Instead, a single mounting rod could be provided and a set of guide plates 25 could be provided with central and eccentric openings 26, 27, respectively, as shown in FIG. 10, in which case the guide plates would then be installed on the mounting rod 22 by pushing the rod through the central or eccentric holes, depending upon the particular application.

For removing the beater bar in FIGS. 6 and 7, and for reinstalling it, the lifting device 19 is moved lengthwise of the arm 15 and the arm 15 is pivoted about the pivot 16, as is required by the particular situation.

It will be understood that each of the elements described above, or two or more together, may also find a useful application in other types of constructions differing from the types described above.

While the invention has been illustrated and described as embodied in a beater bar for rotors of impact mills, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a material-treating beater bar of the type which is mounted in peripheral cut-outs of the rotor of an impact mill in such a manner that an outer part of the beater bar side face which is the leading surface as considered in the direction of rotation of the rotor projects freely beyond the rotor periphery and directly contacts material to be treated, the improvement wherein said side face and another side face parallel thereto are each provided with a longitudinally extending rib, said ribs each being offset from the longitudinal midpoint line of the respective side faces in opposite directions, said side faces due to the offsetting of the ribs each having a larger and a smaller face portion of which the larger face portions partially overlap one another.

2. A beater bar as defined in claim 1, wherein said bar has a rectangular cross-section.

3. A beater bar as defined in claim 1, wherein said bar has a parallelogram-shaped cross-section.

4. A beater bar as defined in claim 1, wherein said bar has a double-trapezoidal cross-section.

5. A beater bar as defined in claim 1, wherein said larger and smaller face portions of each side face are located in respective mutually inclined planes which intersect one another, and wherein said ribs are located in the region of the intersection of said planes.

6. A beater bar as defined in claim 1, wherein said ribs are each provided with at least one recess having a base surface which is coplanar with the respective larger face portion.

7. A beater bar as defined in claim 4, wherein said ribs are of triangular cross-section.

8. A beater bar as defined in claim 7, wherein each rib has one surface facing towards said larger face portion and another surface facing towards said smaller face portion, and wherein said one surface is steeper than said other surface.

9. A beater bar as defined in claim 1, and further comprising a reinforcing bead at an outer margin of the respective smaller face portion.

10. A beater bar as defined in claim 1, wherein said bar is formed with a hollow which extends in the region of its central longitudinal axis from one to the other of the axial ends of said bar.

11. A beater bar as defined in claim 10, wherein said hollow has an elongated cross-section, and wherein the elongation of said cross-section extends in the direction of elongation of the cross-section of said bar.

12. A beater bar as defined in claim 11, wherein the distance between said hollow and said smaller face portions is greater than the distance between said hollow and said larger face portions.

13. A beater bar for rotors of impact mills, comprising an elongated bar body formed with a hollow in the region of its central longitudinal axis and having two opposite side faces each provided with a longitudinally extending rib, said ribs each being offset from the longitudinal midpoint line of the respective side faces in opposite directions, said side faces due to the offsetting of said ribs each having a larger and a smaller face portion, and the larger face portions of said side faces at least partially overlapping one another; and a mounting rod extending through said hollow and projecting outwardly beyond the opposite ends of said bar body.

14. A beater bar as defined in claim 13; further comprising guide plates mounted on said mounting rod, said guide plates having a contour corresponding to the cross-section of said hollow and being located within the latter so as to support said bar body on said mounting rod.

15. A beater bar as defined in claim 14, wherein each of said guide plates has a central hole and an eccentric hole through which said mounting rod may be selectively passed.

16. A beater bar as defined in claim 14, wherein said guide plates are for use with unworn beater bars; and further comprising an additional mounting rod and associated additional guide plates for use with one-sidedly worn beater bars in lieu of the first-mentioned mounting rod and guide plates.

17. A beater bar as defined in claim 1, wherein the cross-section of said bar, inclusive of the ribs, is free of undercuts relative to a diagonal line passing through said cross-section.

* * * * *